US009447748B2

(12) United States Patent
Alexander

(10) Patent No.: US 9,447,748 B2
(45) Date of Patent: Sep. 20, 2016

(54) CYLINDER HEAD WITH COOLING CHANNEL

(71) Applicant: McLaren Automotive Limited, Woking (GB)

(72) Inventor: Stuart Alexander, Woking (GB)

(73) Assignee: MCLAREN AUTOMOTIVE LIMITED, Woking (GB)

( * ) Notice: Subject to any disclaimer, the term of this patent is extended or adjusted under 35 U.S.C. 154(b) by 52 days.

(21) Appl. No.: 14/010,272

(22) Filed: Aug. 26, 2013

(65) Prior Publication Data

US 2014/0238319 A1 Aug. 28, 2014

(30) Foreign Application Priority Data

Feb. 26, 2013 (GB) ..... 1303402.0

(51) Int. Cl.
*F02F 1/40* (2006.01)
*F01P 3/02* (2006.01)
*F02F 1/10* (2006.01)

(52) U.S. Cl.
CPC .. *F02F 1/40* (2013.01); *F01P 3/02* (2013.01); *F02F 1/10* (2013.01); *Y10T 29/4927* (2015.01)

(58) Field of Classification Search
CPC ..... F02F 1/26; F02F 1/36; F02F 1/38; F02F 1/40; F02F 1/10; Y10T 29/4927; F01P 3/00; F01P 3/02; F01P 3/12; F01P 2003/024; F01P 7/14
USPC ..... 123/41.71, 41.76, 41.77, 41.82 R
See application file for complete search history.

(56) References Cited

U.S. PATENT DOCUMENTS

| | | | | |
|---|---|---|---|---|
| 4,690,105 | A * | 9/1987 | Kanda | 123/41.82 R |
| 4,730,579 | A * | 3/1988 | Yamada et al. | 123/41.82 R |
| 4,860,700 | A * | 8/1989 | Smith | 123/41.31 |
| 4,889,079 | A * | 12/1989 | Takeda et al. | 123/41.82 R |
| 5,081,960 | A * | 1/1992 | Shimamoto | 123/41.82 R |
| 5,133,304 | A * | 7/1992 | Koshimoto et al. | 123/41.82 R |
| 6,481,392 | B1 * | 11/2002 | Etemad | 123/41.74 |
| 6,810,838 | B1 | 11/2004 | Hellman | |
| 7,007,637 | B2 * | 3/2006 | Hwang | 123/41.72 |
| 7,086,357 | B2 * | 8/2006 | Mac Vicar et al. | 123/41.82 R |
| 7,270,091 | B2 * | 9/2007 | Matsui et al. | 123/41.82 R |
| 7,743,741 | B2 * | 6/2010 | Matsuda | 123/41.82 R |
| 7,784,442 | B2 * | 8/2010 | Lester et al. | 123/193.5 |
| 7,992,535 | B2 * | 8/2011 | Steiner | F01L 1/022 123/196 AB |
| 8,082,894 | B2 * | 12/2011 | Poschl | F02F 1/40 123/193.5 |
| 8,397,682 | B2 * | 3/2013 | Hamada | 123/41.82 R |

(Continued)

FOREIGN PATENT DOCUMENTS

| | | | | |
|---|---|---|---|---|
| DE | 19934667 | A1 | 1/2001 | |
| EP | 1632653 | A1 * | 3/2006 | |
| JP | 61142353 | A * | 6/1986 | F02F 1/36 |

OTHER PUBLICATIONS

UK Intellectual Property Office Search Report for Application No. GB1303403.8, dated Jun. 11, 2014.

*Primary Examiner* — Grant Moubry
(74) *Attorney, Agent, or Firm* — Dergosits & Noah LLP

(57) ABSTRACT

A cylinder head for an internal combustion engine, the cylinder head including a region for covering a combustion cylinder, the region including one or more ports for communicating with the cylinder, and the cylinder head including a coolant channel that embraces at least one of the ports for cooling the zone of the cylinder head adjacent the port.

20 Claims, 5 Drawing Sheets

(56) References Cited

U.S. PATENT DOCUMENTS 8,544,427 B2 * 10/2013 Maruyama et al. ... 123/41.82 R
8,550,040 B2 * 10/2013 Okada ..... 123/41.76
8,776,735 B2 * 7/2014 Kosugi et al. ..... 123/41.7
8,899,207 B2 * 12/2014 Megel et al. ..... 123/193.5
2004/0177818 A1 9/2004 Krotky et al.
2009/0000578 A1 1/2009 Reustle
2011/0277708 A1 * 11/2011 Geiser et al. ..... 123/41.82 R

* cited by examiner

CYLINDER HEAD WITH COOLING CHANNEL

CROSS-REFERENCE TO RELATED APPLICATIONS

This patent application claims priority to Great Britain Patent Application GB 1303402.0, filed Feb. 26, 2013, entitled "Engine Cooling," which is incorporated by reference.

BACKGROUND

This invention relates to engine cooling.

BRIEF SUMMARY OF THE INVENTION

A conventional internal combustion engine comprises an engine block which defines combustion cylinders. Each cylinder is closed at one end by a piston that is movable in the cylinder, and at the other end by a wall provided by a cylinder head. The cylinder head is a rigid unit that is attached firmly to the engine block. In order to permit combustion gas to enter the cylinders and exhaust gas to escape the cylinders are provided with valves which, when opened, permit the cylinders to communicate with inlet and exhaust channels. Conventionally the valves are mounted on the cylinder head and communicate with the cylinders through openings in the cylinder head.

In designing a cylinder head it is desirable to provide for sufficient velocity of gas flow whilst minimising losses. This typically results in inlet and exhaust ports occupying a large proportion of the area over each cylinder. However, this causes another problem. When the area of the ports is large, the amount of material remaining in the cylinder head is reduced and this can leave thin necks of material in the parts of the cylinder head that overlie the ends of the cylinders. For illustration, FIG. 1 shows part of a cylinder head viewed from the side that would normally face the cylinder. In FIG. 1 the ring marked 1 indicates where the cylinder head would meet the side-wall of the cylinder, the ports marked 2 are inlet ports and the ports marked 3 are exhaust ports. It will be seen that the ports occupy a large part of the cylinder-closing area of the cylinder head, and that as a result there are thin necks of material as indicated at 4, commonly known as valve bridges. The thinness of these necks of material means that the flow of heat from the necks to the bulk of the cylinder head is relatively poor. As a result, heat can build up in the necks. That heat build-up could result in mechanical failure of the cylinder head. The problem of heat build-up can be particularly acute in a neck between exhaust valves because of the high temperature of the exhaust gas. In FIG. 1, shading indicates simulated temperatures during operation of an engine using that cylinder head, with darker shading indicated higher simulated temperatures. It will be seen that the neck between the exhaust valves 3 is particularly dark.

One way of reducing the build-up of heat in the cylinder head is to restrict the power of the engine. However, this is not desirable in an engine intended for a sports vehicle.

US 2004/0177818 describes a cylinder head with a bore for coolant which runs linearly between the exhaust ports.

There is a need for an improved way of improving temperature control in the cylinder head of an internal combustion engine.

According to the present invention there is provided a cylinder head for an internal combustion engine, the cylinder head comprising a region for covering a combustion cylinder, the region comprising one or more ports for communicating with the cylinder, and the cylinder head comprising a coolant channel that embraces at least one of the ports for cooling the zone of the cylinder head adjacent that port.

The said at least one of the ports may be an exhaust port or an inlet port. The coolant channel may circumscribe at least 180° of at the said at least one of the ports.

The coolant channel may embrace and/or run between at least two ports for a common cylinder. The said at least two ports may be adjacent exhaust or inlet ports. The coolant channel may circumscribe at least 180° of each of the said at least two ports.

The coolant channel may comprise a median channel that runs between the said at least two ports. The coolant channel may comprise branches that diverge from the median channel, each of the branches running partially around a respective one of the at least two ports.

The median region may comprise a single path in the zone where the said at least two ports approach each other most closely. On one side of that zone the median channel may be connected to the branches. On the other side of that zone the median channel may be at least partially bifurcated.

The cylinder head may comprise a coolant inlet communicating with the median channel at an end distant from its connection to the branches.

The inlet may extend to an engine-block-facing surface of the cylinder head.

The cylinder head may comprise coolant outlets communicating with the branches at their ends distant from their connection to the median channel.

The minimum cross-sectional area of the inlet may be less than the total of the minimum cross-sectional areas of the outlets.

The median channel and the branches may lie generally in a plane.

According to a second aspect of the invention there is provided a method of forming a cylinder head as set out above, wherein the coolant channel is formed in the cylinder head by casting.

The coolant channel may be formed in the cylinder head without drilling.

The present invention will now be described by way of example with reference to the accompanying drawings.

BRIEF DESCRIPTION OF THE FIGURES

In the drawings:

In FIGS. 2 to 4 like parts are given the same numbers. In FIG. 5 a component of the core that defines a part of the channel shown in FIGS. 2 to 4 is indicated by the number of that part followed by an asterisk.

DETAILED DESCRIPTION

Figure 1:
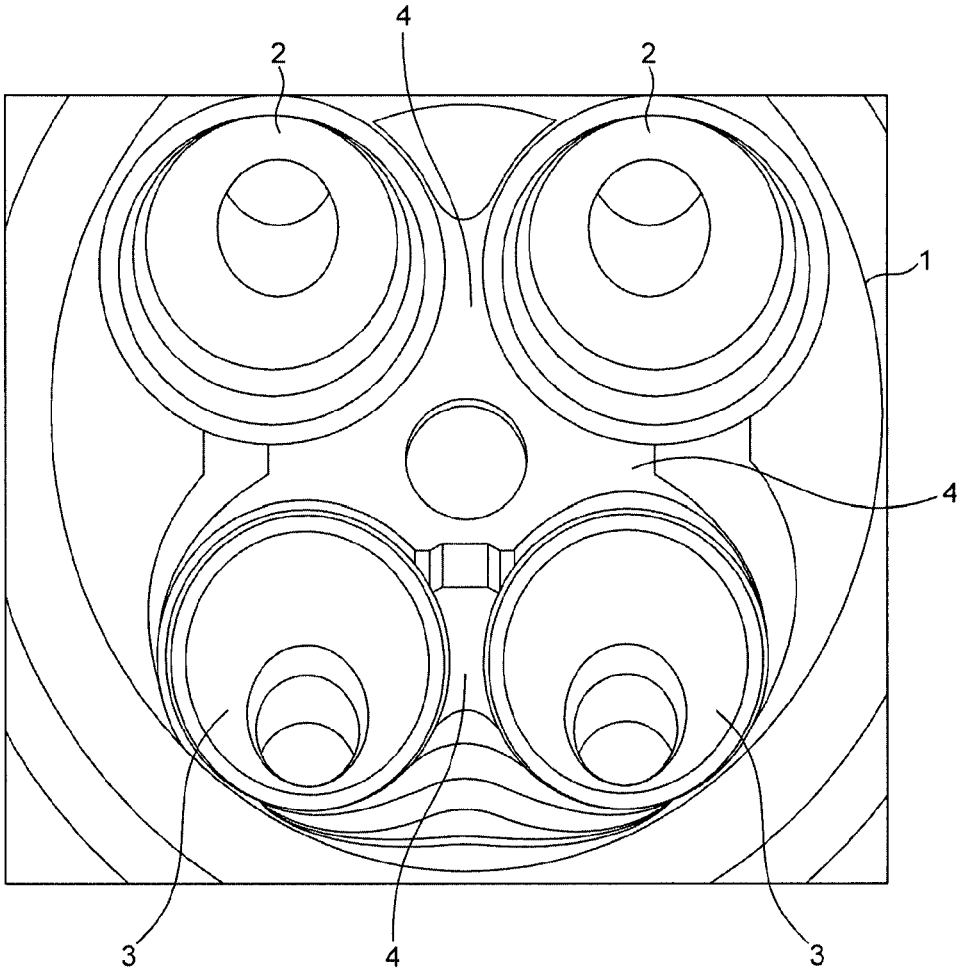
FIG. 1 shows a cylinder head.
Figure 2:
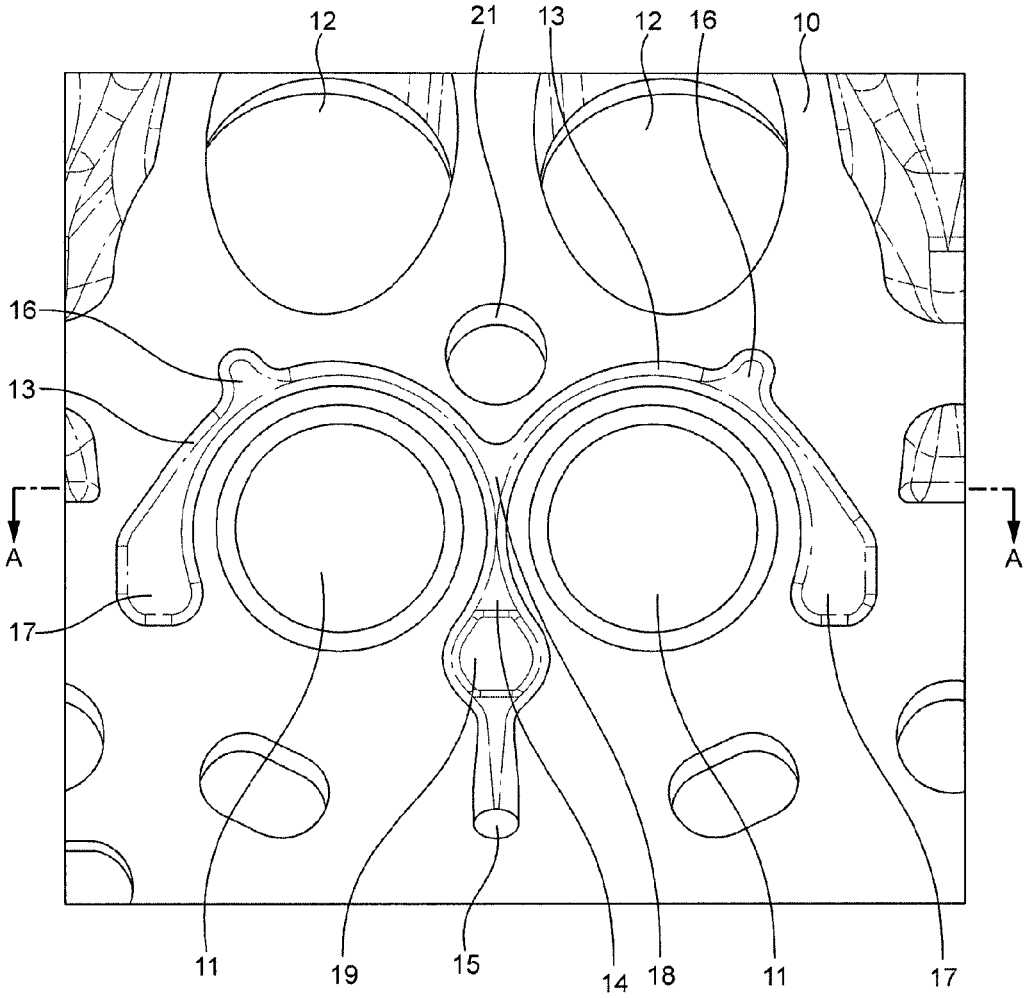
FIG. 2 shows a cross-section perpendicular to the cylinder axis through a cylinder head including a cooling channel.
Figure 3:
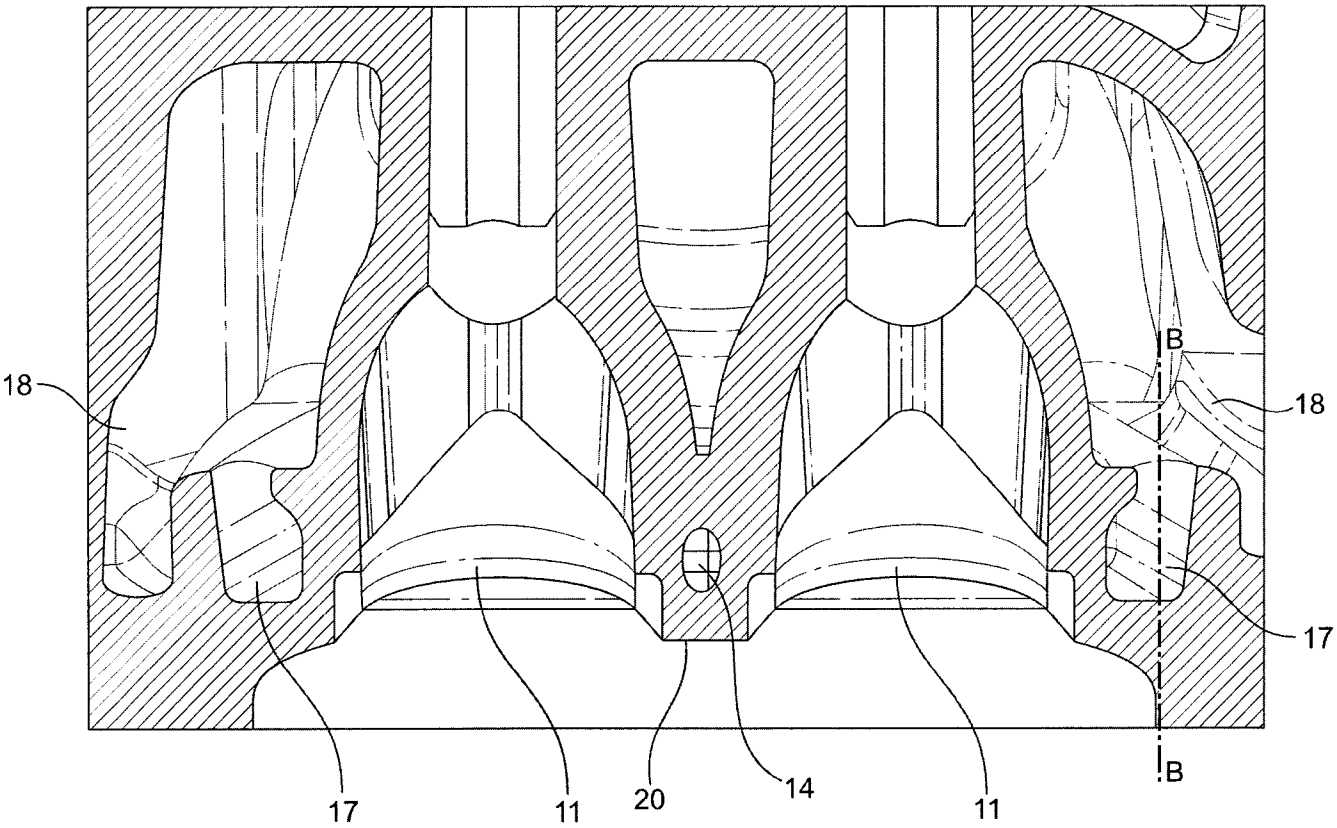
FIG. 3 shows a cross section through the cylinder head of FIG. 2 on the axis A-A of FIG. 2.
Figure 4:
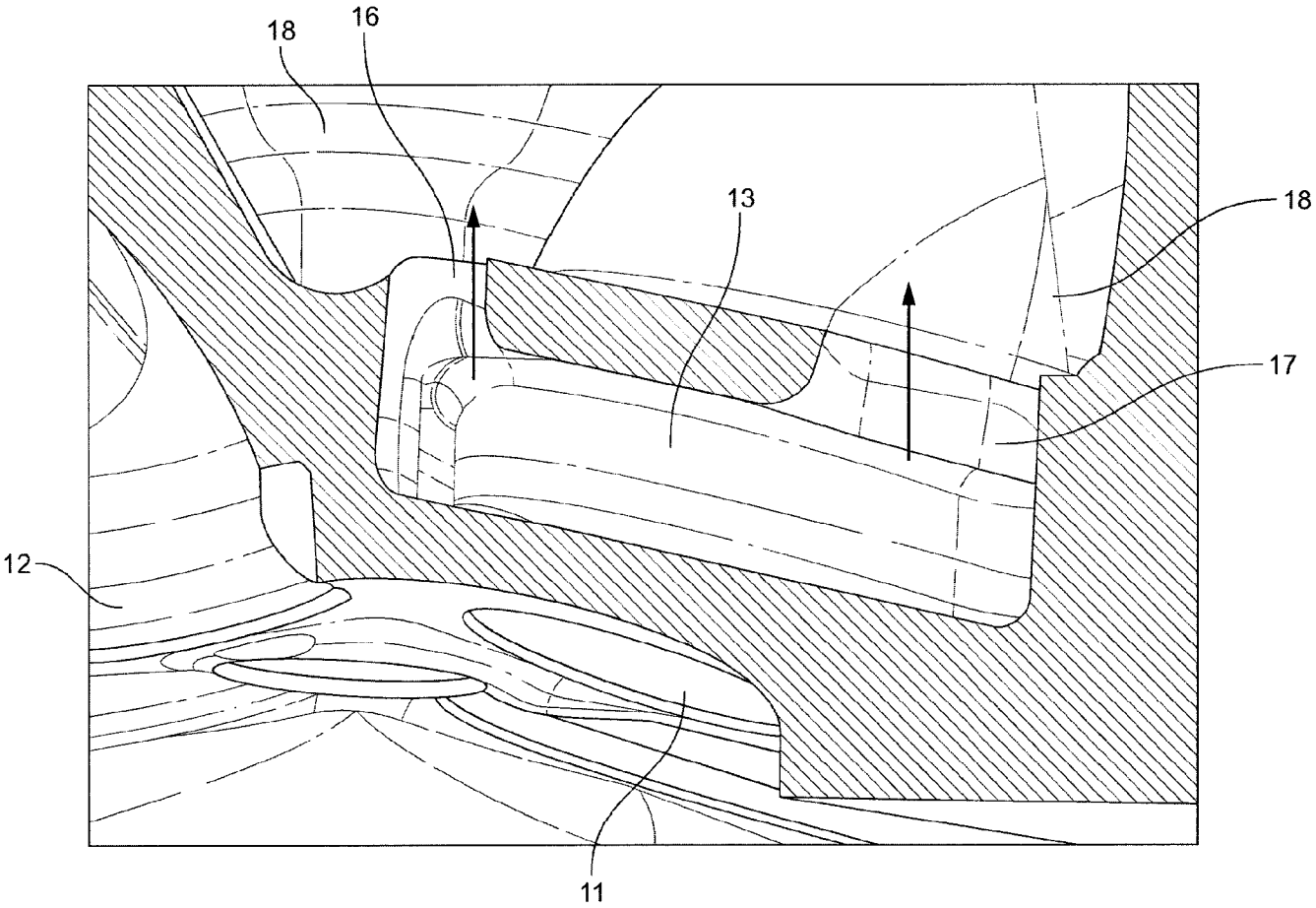
FIG. 4 shows a cross section through the cylinder head of FIG. 2 on line B-B of FIG. 3.

The cylinder head 10 of FIGS. 2 to 4 includes exhaust ports 11 and inlet ports 12. A coolant passageway 13, 14 is formed in the cylinder head. The passageway 13, 14 embraces the exhaust ports. In that way coolant flowing through the passageway can effectively extract heat from the region surrounding the exhaust ports.

In more detail, FIG. 2 shows a cross-section through part of a cylinder head perpendicular to the cylinder axis and facing the cylinders. The part of the cylinder head shown in FIG. 2 represents the majority of the part of the cylinder head that would face and cover a single cylinder. It comprises two inlet ports 12, two exhaust ports 11 and a hole 21 for receiving a spark plug as in some known cylinder heads. It also comprises arcuate channels indicated generally at 13 and 14 which embrace the exhaust ports. As will be described below, the arcuate channels are formed within the body of the cylinder head and when the cylinder head is built into an engine they communicate with a cooling system which can cause coolant to pass through the arcuate channels. The arcuate channels are isolated from the openings from the cylinder head to the cylinder so that coolant can pass through the arcuate channels without it leaking to into the cylinders. Because the arcuate channels wrap around the exhaust ports, and especially because they run transverse to the cylinder axis through the region between the exhaust ports, they can be highly effective to permit coolant to cool the region of the cylinder head around the exhaust valves. In a cylinder head of the design illustrated in the figures, the most critical region for cooling is the bridge between the exhaust ports. The arcuate channels are set inside the cylinder head and do not communicate with the inlet or exhaust ports of the engine.

The arcuate channels are designed to permit cooling fluid such as water to pass between an inlet 15 and outlets 16, 17. Fluid received at the inlet runs along a median section 14 which runs between the exhaust ports. The median section runs generally transverse to the cylinder axis, so it spans the region of the cylinder head between the exhaust ports relatively close to the cylinder-facing exterior surface 20 of the cylinder head. (See FIG. 3). At the end 18 of the median section the fluid path splits into two semi-circular channels 13. Each semi-circular channel runs around part of the periphery of a respective one of the exhaust ports. Part-way along each semi-circular channel is a first outlet 16. At the end of each semi-circular channel is a second outlet 17. Fluid flowing from the median channel passes along either of the semi-circular channels and leaves the system of arcuate channels via one of the outlets 16, 17.

The manner in which coolant is introduced to and removed from the arcuate channels will depend on the details of the engine in which they are to be used, and particularly the details of its cooling system. In one convenient example, the engine could have a system of passages for circulating coolant which are embedded in the engine block and the cylinder head. A gasket could be installed between the engine block and the cylinder head to seal the two together and to permit coolant to pass between the two without leaking into the cylinders. The inlet 15 and the outlets 16, 17 could then be configured to communicate with other coolant passages in the engine block and/or the cylinder head in order to receive fluid to and expel fluid from the arcuate channels. Conveniently the arcuate channels generally occupy a plane and the inlets and outlets extend out of that plane in order to communicate with other parts of the coolant system.

In this example, inlet 15 is configured to extend from the median section towards the base of the cylinder head: that is the face of the cylinder head that will abut the engine block when the two are mated together. The inlet 15 is intended to communicate with a corresponding coolant passage exposed on the upper surface of the engine block for receiving coolant therefrom. Thus the arcuate channels are served by a separate inlet to the cylinder head from any bulk cooling to the cylinder head. This allows the pressure in the arcuate channels to be regulated independently of any bulk cooling in the cylinder head. This regulation could be by means of the cross-section of inlet 15, the cross-section of the passage with which it communicates in the cylinder head, or the size of the hole in the cylinder head gasket that serves inlet 15. Outlets 16 and 17 extend from the semi-circular channels 13 away from the base of the cylinder head. As shown in FIG. 4, they then communicate with other coolant passages in the cylinder head. Conveniently, the coolant system is designed so that in operation there is a pressure differential between the inlet and the outlets. Conveniently the inlet is connected to a relatively high pressure source of coolant and the outlets are connected to a relatively low pressure coolant passage. It is convenient for the source of higher pressure coolant to be generally towards the base of the engine.

It is advantageous for the arcuate channels to be designed so that there is a substantial pressure difference between the inlet and the outlets and so that the channels are relatively narrow. This promotes a high velocity of coolant through the channels, which assists cooling. Flow through the arcuate channels can also be controlled by the relative effective (i.e. minimum) cross-sectional areas of the inlet and, collectively, the outlets. Preferably the minimum cross-sectional area of the inlet is smaller than the total of the minimum cross-sectional areas of the outlets.

In the region of the median channel 14 between the inlet 15 and the fork 18 where the semi-circular branch channels 13 connect to the median channel the median channel is bifurcated at 19. The median channel passes between the exhaust ports 11 and it is preferable for it to be located close to the surface of the exhaust ports but without being so wide as to result in substantially reduced flow velocities. By bifurcating the median channel at 19 the channel can pass close to the surface of the exhaust ports around a greater part of their circumference than a linear median channel of the same height and cross-section would do. The bifurcation of the median channel could be complete, with two entirely separate paths in the bifurcated section, or partial, with a diversion in the channel which directs flow on either side of it and either above or below it. The latter arrangement is preferable if the channel is formed by casting since it makes the required mould core less delicate.

As illustrated in FIG. 3, the cross-section of the median passage 14 can be longer in the direction perpendicular to the base of the cylinder head than in the direction parallel to the cylinder head. This can assist cooling whilst maintaining adequate material between the passage and the exhaust ports for strength of the cylinder head.

When much of the over-cylinder area of a cylinder head is occupied by valve ports and spark plug ports, much of the remainder of the area is occupied by relatively thin webs of material such as the one described above that runs between the exhaust ports. Arcuate channels of the type described above could be used to cool any of those webs, by embracing ports adjacent to the webs. Similarly, if the engine has a single exhaust port, an arcuate channel could embrace that single exhaust port. In each case it is preferable that the or each channel does not completely surround an adjacent port since that would make it harder to force coolant through the channel at relatively high velocity. For that reason it is preferable that the channel embraces one or more ports without encircling it/them. The channel may, for example run around more than 180° of the circumference of one or more ports.

Valve seats surround the inlet and exhaust ports so that inlet and outlet valves can seal the ports at the appropriate points in the engine's cycle. Cooling the region around the exhaust ports can reduce heating of the exhaust valves and thereby improve their longevity. The valve seats may be constituted by seat inserts which are not integral with the main body of the cylinder head but instead are attached to the cylinder head around the valve openings. It is preferable that the cooling channels do not make contact with the seat inserts, but are instead within the body of the cylinder head in the region of the valve openings. In that way there is no need for the valve seats to seal the cooling channels.

By providing additional cooling to the region adjacent each cylinder, as described above, the knock-sensitivity of the engine can be reduced.

Figure 5:
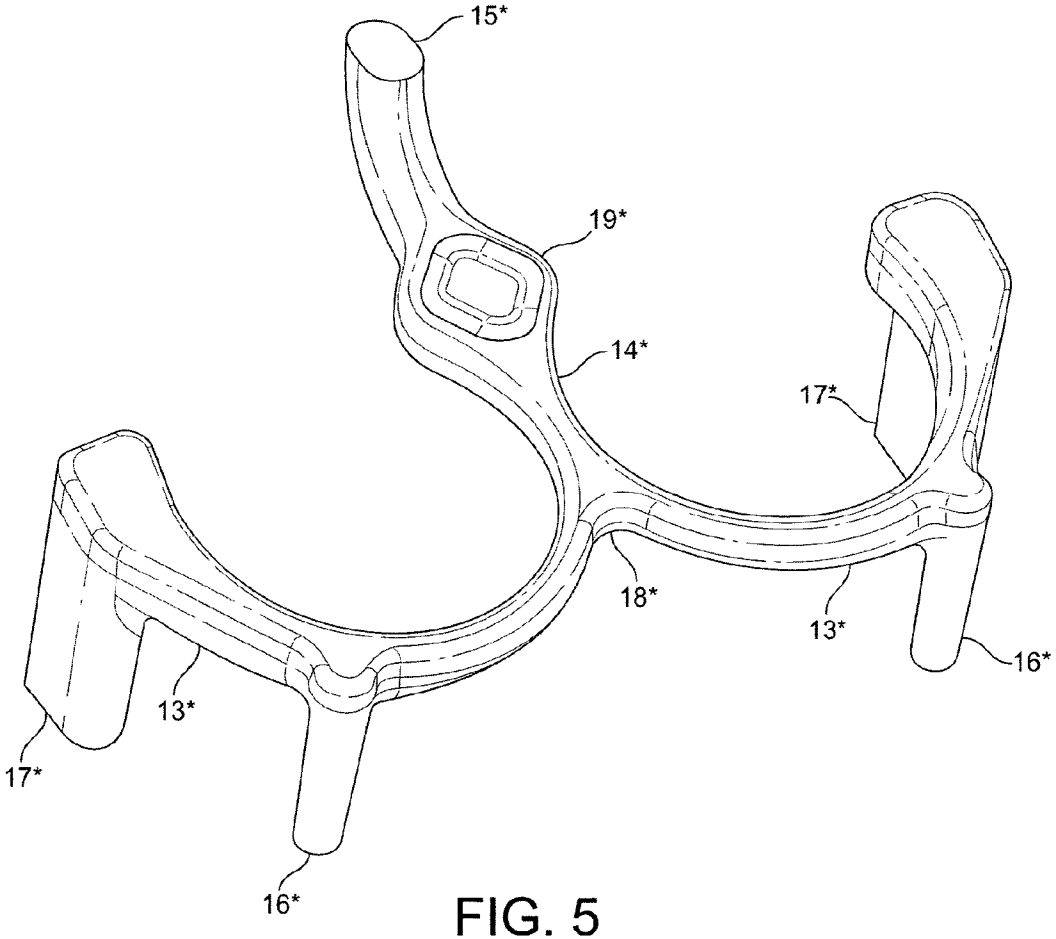
FIG. 5 shows a mould core for forming the cooling channel of the cylinder head of FIG. 2.

The cylinder head is formed from a unitary block of material. The cylinder head may be formed of a metal such as aluminium or an aluminium alloy. The cylinder head may be formed primarily by casting, although some post-casting machining may be used. Channels that embrace the exhaust ports could be formed from an interconnected network of drillings, some of whose ends could then be plugged to prevent leakage of coolant out of the cylinder head. However, it is preferable for the arcuate channels to be cast into the cylinder head and most preferably to be formed without drilling into the cylinder head. FIG. 5 shows a sand core that could be used for this purpose. Limbs 16* of the sand core serve an additional purpose beyond simply defining the additional fluid exits 16. The sand core has a generally planar region 13*, 14* which defines the arcuate channels. Limbs 16* and 17* extend out of that plane and, as a set, are offset in orthogonal directions in that plane. This means that the sand core can sit stably on limbs 16* and 17* before or during the casting process, which can help to reduce the risk of the sand core breaking or shifting during casting.

In an engine having multiple cylinders the cooling arrangement described above can be implemented for each cylinder. In such an arrangement, the inlet of the coolant passage for each cylinder that shares the cylinder head could communicate independently with the engine block. The outlets of the passages in that cylinder head could communicate with a common fluid jacket formed in the cylinder head.

As can be appreciated, there are many aspects and embodiments of the invention. Presented below in example claim format are various embodiments and aspects of the invention. The invention may include any one or combination of the aspects recited.

1. A cylinder head for an internal combustion engine, the cylinder head comprising a region for covering a combustion cylinder, the region comprising one or more ports for communicating with the cylinder, and the cylinder head comprising a coolant channel that embraces at least one of the ports for cooling the zone of the cylinder head adjacent that port.

2. A cylinder head as claimed in claim 1, wherein the said at least one of the ports is an exhaust port.

3. A cylinder head as claimed in claim 2, wherein the coolant channel circumscribes at least 180° of at the said at least one of the ports.

4. A cylinder head as claimed in claim 1, wherein the coolant channel embraces at least two ports for a common cylinder.

5. A cylinder head as claimed in claim 1 or 4, wherein the coolant channel runs between at least two ports for a common cylinder.

6. A cylinder head as claimed in claim 4 or 5, wherein the said at least two ports are adjacent exhaust ports.

7. A cylinder head as claimed in any of claims 4 to 6, wherein the coolant channel circumscribes at least 180° of each of the said at least two ports.

8. A cylinder head as claimed in any of claims 4 to 7, wherein the coolant channel comprises a median channel that runs between the said at least two ports and branches that diverge from the median channel, each of the branches running partially around a respective one of the at least two ports.

9. A cylinder head as claimed in claim 8, wherein:

the median region comprises a single path in the zone where the said at least two ports approach each other most closely;

on one side of that zone the median channel is connected to the branches; and on the other side of that zone the median channel is at least partially bifurcated.

10. A cylinder head as claimed in claim 8 or 9, comprising a coolant inlet communicating with the median channel at an end distant from its connection to the branches.

11. A cylinder head as claimed in claim 10, wherein the inlet extends to an engine-block-facing surface of the cylinder head.

12. A cylinder head as claimed in any of claims 8 to 11, comprising coolant outlets communicating with the branches at their ends distant from their connection to the median channel.

13. A cylinder head as claimed in claim 12 as dependent on claim 10 or 11, wherein the minimum cross-sectional area of the inlet is less than the total of the minimum cross-sectional areas of the outlets.

14. A cylinder head as claimed in any of claims 8 to 13, wherein the median channel and the branches lie generally in a plane.

15. A method of forming a cylinder head as claimed in any preceding claim, wherein the coolant channel is formed in the cylinder head by casting.

16. A method of forming a cylinder head as claimed in any preceding claim, wherein the coolant channel is formed in the cylinder head without drilling.

17. An engine comprising a cylinder head as claimed in any of claims 1 to 14.

18. A vehicle comprising an engine as claimed in claim 17.

19. A cylinder head or a method of forming a cylinder head substantially as herein described with reference to FIGS. 2 to 5 of the accompanying drawings.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A cylinder head for an internal combustion engine, the cylinder head comprising:

a region for covering a combustion cylinder, the region comprising two or more ports for communicating with the combustion cylinder;

a coolant channel that embraces without encircling at least two of the ports for a common cylinder for cooling a zone of the cylinder head adjacent the at least two ports, the coolant channel comprising a median channel that runs between the at least two ports and branches that diverge from the median channel, each of the branches running partially around a respective one of the at least two ports, wherein the coolant channel circumscribes at least 180° of each of the at least two ports;

a coolant inlet communicating with the median channel at an end distant from a median channel's connection to the respective branches; and coolant outlets communicating with the branches at branch ends distant from the median channel's connection to the respective branches.

2. The cylinder head as claimed in claim 1, wherein at least one of the at least two ports is an exhaust port.

3. The cylinder head as claimed in claim 1, wherein the at least two ports are adjacent exhaust ports.

4. The cylinder head as claimed in claim 1, wherein:

the median channel region comprises a single path in a portion of the zone where the at least two ports approach each other most closely;

on one side of that the portion of the zone the median channel is connected to the branches; and on the other side of that the portion of the zone the median channel is at least partially bifurcated.

5. The cylinder head as claimed in claim 4, wherein the median channel and the branches lie generally in a plane.

6. The cylinder head as claimed in claim 5, wherein the coolant inlet extends to an engine-block-facing surface of the cylinder head.

7. The cylinder head as claimed in claim 4, wherein the coolant inlet and coolant outlets each have a respective minimum cross-sectional area, and the minimum cross-sectional area of the inlet is less than a total of the minimum cross-sectional areas of the outlets.

8. The cylinder head as claimed in claim 7, wherein the median channel and the branches lie generally in a plane.

9. The cylinder head as claimed in claim 8, wherein the coolant inlet extends to an engine-block-facing surface of the cylinder head.

10. The cylinder head as claimed in claim 1, wherein the coolant inlet extends to an engine-block-facing surface of the cylinder head.

11. The cylinder head as in claim 10, wherein the coolant inlet and coolant outlets each have a respective minimum cross-sectional area, and the minimum cross-sectional area of the inlet is less than a total of the minimum cross-sectional area of the outlets.

12. The cylinder head as claimed in claim 11, wherein the median channel and the branches lie generally in a plane.

13. The cylinder head as claimed in claim 1, wherein the coolant inlet and coolant outlets each have a respective minimum cross-sectional area, and the minimum cross-sectional area of the inlet is less than a total of the minimum cross-sectional areas of the outlets.

14. The cylinder head as in claim 13, wherein the median channel and the branches lie generally in a plane.

15. The cylinder head as claimed in claim 1, wherein the median channel and the branches lie generally in a plane.

16. A method of forming the cylinder head as claimed in claim 1, wherein the coolant channel is formed in the cylinder head by casting.

17. A method of forming the cylinder head as claimed in claim 1, wherein the coolant channel is formed in the cylinder head without drilling.

18. An engine comprising the cylinder head as claimed in claim 1.

19. A vehicle comprising the engine as claimed in claim 18.

20. The cylinder head as in claim 1, wherein at least one of the branches is an arcuate channel.

* * * * *